US011896153B2

(12) United States Patent
Hall et al.

(10) Patent No.: US 11,896,153 B2
(45) Date of Patent: Feb. 13, 2024

(54) BED SHEET FOR BED WITH NEGATIVE SPACE

(71) Applicant: Sonu Sleep Corporation, Los Angeles, CA (US)

(72) Inventors: Bradley Hall, Los Angeles, CA (US); Stason Strong, Playa del Rey, CA (US)

(73) Assignee: SONU SLEEP CORPORATION, Los Angeles, CA (US)

( * ) Notice: Subject to any disclaimer, the term of this patent is extended or adjusted under 35 U.S.C. 154(b) by 0 days.

(21) Appl. No.: 18/044,741

(22) PCT Filed: Sep. 13, 2021

(86) PCT No.: PCT/US2021/050027
§ 371 (c)(1),
(2) Date: Mar. 9, 2023

(87) PCT Pub. No.: WO2022/060660
PCT Pub. Date: Mar. 24, 2022

(65) Prior Publication Data

US 2023/0263320 A1 Aug. 24, 2023

Related U.S. Application Data

(60) Provisional application No. 63/078,484, filed on Sep. 15, 2020.

(51) Int. Cl.
*A47G 9/02* (2006.01)

(52) U.S. Cl.
CPC ..... *A47G 9/0246* (2013.01)

(58) Field of Classification Search
CPC ..... A47G 9/0246; A47G 9/0238; A47G 9/10; A47G 9/0253; A47C 27/142; A47C 27/146; A47C 27/144; A47C 27/148; A47C 27/15; A47C 19/021; A47C 23/00; A47C 31/105
USPC ..... 5/497
See application file for complete search history.

(56) References Cited

U.S. PATENT DOCUMENTS

| | | | | |
|---|---|---|---|---|
| 2,569,627 | A * | 10/1951 | Black | A47G 9/0246 5/497 |
| 3,654,646 | A * | 4/1972 | McMahon, Jr. | A47G 9/0246 5/482 |
| 4,244,066 | A * | 1/1981 | Rukawina | A61G 7/02 4/450 |
| 4,932,344 | A * | 6/1990 | Tatum | D05B 35/04 112/475.08 |
| 5,189,744 | A | 3/1993 | Roberts | |
| 5,398,354 | A | 3/1995 | Balonick et al. | |
| 9,084,703 | B1 * | 7/2015 | Fair | A61G 7/02 |
| 2006/0096034 | A1 * | 5/2006 | Tucci | A47C 20/026 5/722 |

(Continued)

FOREIGN PATENT DOCUMENTS

DE 199003874 7/1990

*Primary Examiner* — Myles A Throop
(74) *Attorney, Agent, or Firm* — Cislo & Thomas, LLP

(57) ABSTRACT

A bedding 100 defining a pocket 102 to fit on top of a bed with negative space to accommodate side sleepers and stomach sleepers by providing a space for the user's arms and shoulders. The pocket 102 is configured to fit inside the negative space of the bed to keep the negative space of the bed clean. For ease of manufacturing, the bedding 100 is made from three separate sheets that are strategically cut and fastened together.

10 Claims, 5 Drawing Sheets

(56) References Cited

U.S. PATENT DOCUMENTS

| | | | | |
|---|---|---|---|---|
| 2006/0168726 | A1 | 8/2006 | Cushing | |
| 2010/0101023 | A1* | 4/2010 | Stephens | A61G 9/003 5/604 |
| 2010/0199436 | A1* | 8/2010 | Schultz | A47C 27/15 5/632 |
| 2019/0045949 | A1* | 2/2019 | Duck | A47G 9/0246 |

* cited by examiner

BED SHEET FOR BED WITH NEGATIVE SPACE

CROSS-REFERENCE TO RELATED APPLICATION

This patent application is a national phase entry of PCT Application No.: PCT/US2021/050027, filed Sep. 13, 2021, which claims priority to U.S. Provisional Patent Application No. 63/078,484, filed Sep. 15, 2020, which applications are incorporated in their entirety here by this reference.

TECHNICAL FIELD

This invention relates to bedding.

BACKGROUND

Traditional mattress designs only allow a sleeper to lay flat, causing discomfort, aches and pains for a large percentage of the population due to the lack of three-dimensional space needed to conform to the shape of the human body. The traditional flat mattress design often results in poor support for neck, shoulder, and back muscles and joints, preventing full comfort for side and stomach sleeping positions, as well as causing overlapping space requirements when sharing a mattress with another sleeper. As such, a new innovative bed has been developed to allow three-dimensional movement of a user's shoulders, arms and neck, greatly increasing comfort by supporting the body in the proper locations, allowing space in the proper locations as well as providing multiple support layers to accommodate for the overlapping of an additional sleeper's limbs in the channel's three-dimensional space as disclosed in PCT/US2021/038817, U.S. patent application Ser. No. 17/071,754, and U.S. patent application Ser. No. 16/926,502, which applications are incorporated in their entirety here by this reference.

In light of this new, innovative bed with negative space, new bedding is required to accommodate the negative space. To preserve the quality and comfort of a bed, fitted sheets are typically used to cover the bed. Typical fitted sheets would not be appropriate for a bed with negative space as the sheet would hide the negative spacing rendering the negative space useless. Simply creating a hole in alignment with the negative space could work, but would weaken the sheet and render it susceptible to easy tearing. For the foregoing reason there is a need for bedding, such as fitted sheets, that can be used on beds with negative space, and an efficient method for manufacturing such sheets.

SUMMARY

The present invention is directed to a bedding to accommodate beds with negative spaces. Due to the negative space, the bedding can have a pocket that fits into the negative space to keep the negative space clean. For example, a fitted bed sheet is generally rectangular and fits on top of a typical mattress and extends down along each side of the mattress, and is generally long enough to tuck under the bottom surface of the mattress. The present invention can be a fitted bed sheet with substantially the same features as the typical fitted sheet with the added feature of a pocket located near the head region that hangs down below the bottom surface of the bedding for insertion into the negative space of the bed.

To improve the manufacturing efficiency of a bed sheet with a pocket descending from the bottom surface of the bed sheet, the bed sheet can be made from three separate sheets. In the preferred embodiment, a base sheet can be generally rectangular with notches created at the corners of the base sheet. The base sheet is dimensioned to cover most of the bed, leaving a portion of the head of the bed exposed. The notches allow the edges of the bed sheet to fold downwardly to cover the sides of the bed. The base sheet region corresponding to the head region of the bed can have a pocket flap that can cover the inferior sidewall and floor of the negative space of the bed. A second rectangular sheet can be fastened to the base sheet at the pocket flap to cover the lateral sidewalls and the superior sidewall. An end sheet that is generally rectangular in shape can be fastened to the second sheet and the base sheet to cover the remainder of the head of the bed.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

In addition, ordinal numbers are not intended to be limited, for example, in sequence. Ordinal numbers are used simply to distinguish one similar feature from another. Similarly, directional terms are not intended to be limiting. Directional terms are used for ease and clarity when describing one element relative to another. In the present application, directional terms are used with reference to a bed laid properly on a surface upon which a person can lie down. Therefore, the top is the direction towards the surface upon which the user lies down. Bottom is the direction of the surface that lays on the surface. Superior is the direction towards the head end of the bed where the user's head would be located. Inferior is the direction towards the foot end of the bed where the user's feet would be located. Lateral is the direction towards the sides of the bed. Medial is the direction towards an imaginary centerline of the bed drawn from the head end (superior) to the foot end (inferior) dividing the bed into equal left and right sides.

Figure 1:
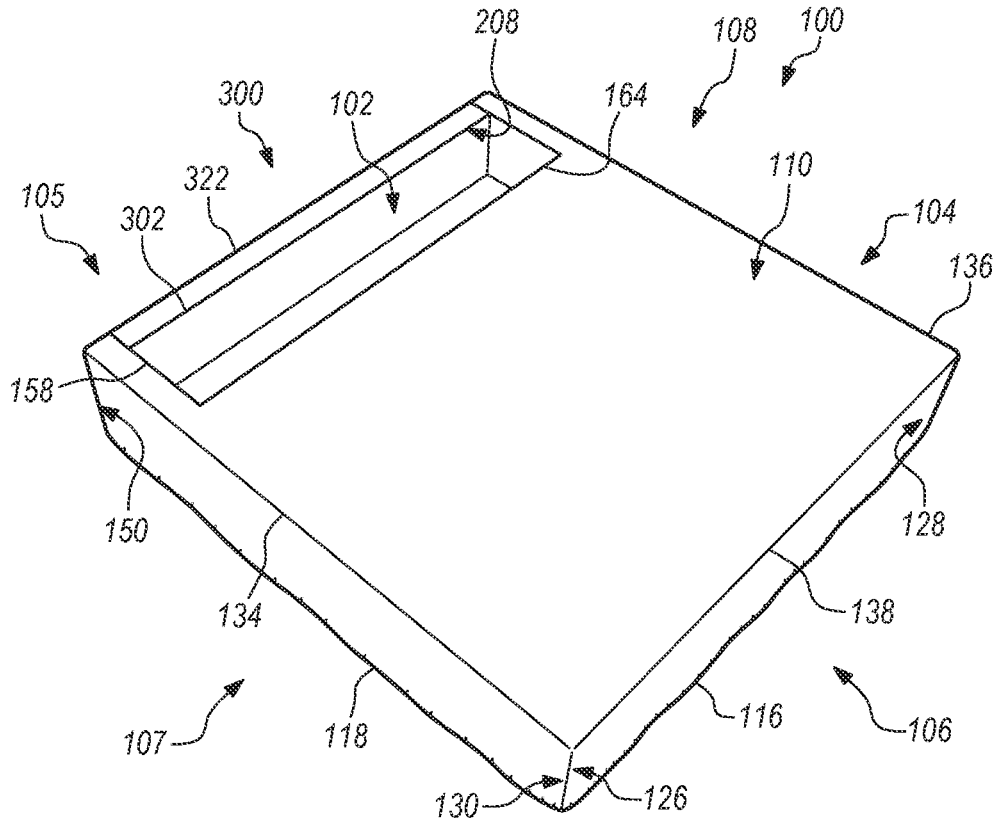
FIG. 1 shows a perspective view of the top side of an embodiment of the bedding from the foot end.
Figure 3:
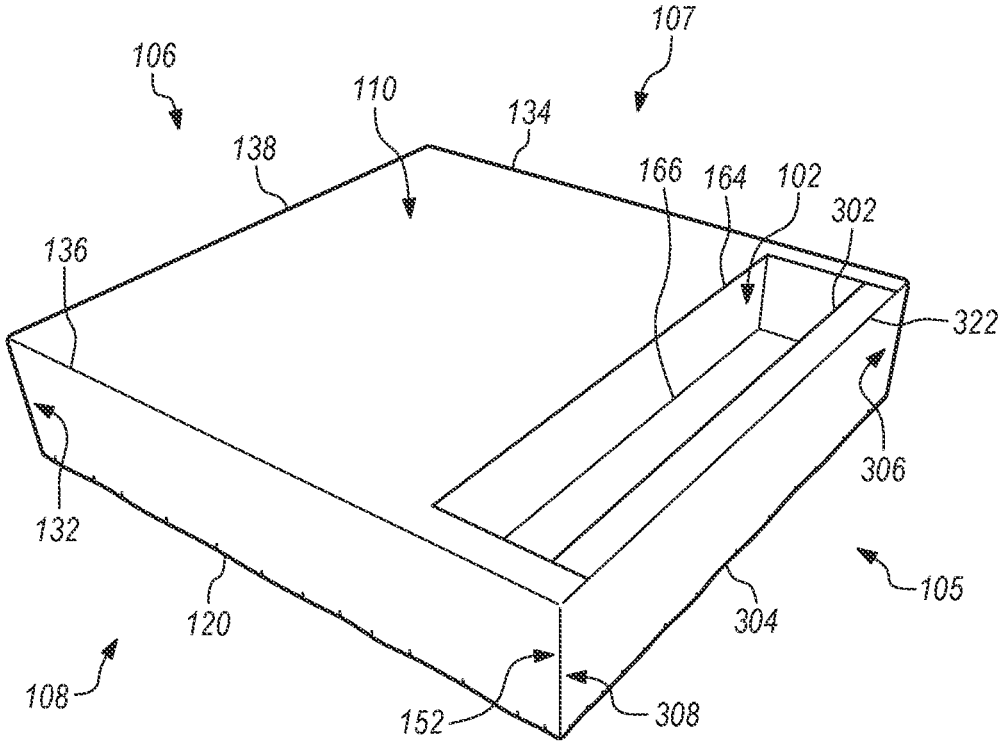
FIG. 3 shows a perspective view of the top side of an embodiment of the bedding from the head end.

With reference to FIGS. 1 and 3, the invention of the present application is a bedding 100 defining a pocket 102 (also referred to as negative space, empty space, channel, hole, and the like) to be fitted onto a bed with negative space at the region of the head and shoulders (i.e. the upper torso region) for allowing users to insert their arms into the pocket 102 when lying on their sides or backs. As such, the bedding 100 comprises a head end 105, a foot end 106 opposite the head end 105, a first side 107 adjacent to the head end 105 and the foot end 106, and a second side 108 opposite the first side 107, and adjacent to the head end 105 and foot end 106. The negative space of the bed is essentially a box-shaped well defined by a floor and four sidewalls (a superior sidewall adjacent to the head end of the bed, an inferior sidewall opposite the superior sidewall and positioned closer to the foot end of the bed than the superior sidewall, a first lateral sidewall adjacent to the first side of the bed, and a second lateral sidewall opposite the first lateral wall and adjacent to the second side of the bed). The negative space of the bed can be other shapes as well, such as oval, hour-glass, and the like. In such embodiments, the pocket 102 of the bedding 100 would have a similar shape to fit inside the negative space of the bed.

The pocket 102 on the bedding 100 allows the user to access to the negative space of the bed with the bedding 100 on top of the bed so that the user can insert his or her arm into the pocket 102 or store bed accessories, such as pillows and blankets, which can also provide support for the user. As such, the pocket 102 can be between the first side 107 and the second side 108 of the bedding 100, and adjacent to the head end 105.

Figure 2:
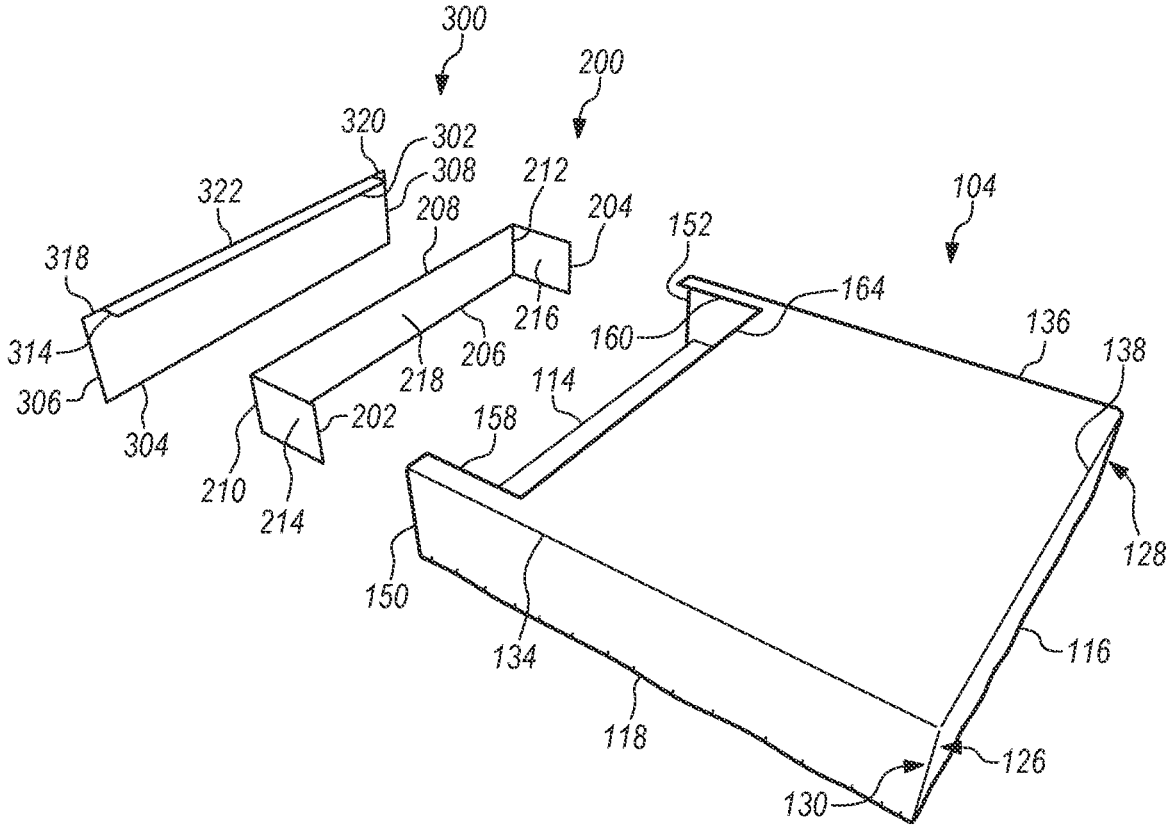
FIG. 2 shows an exploded view of the bedding shown in FIG. 1.
Figure 4:
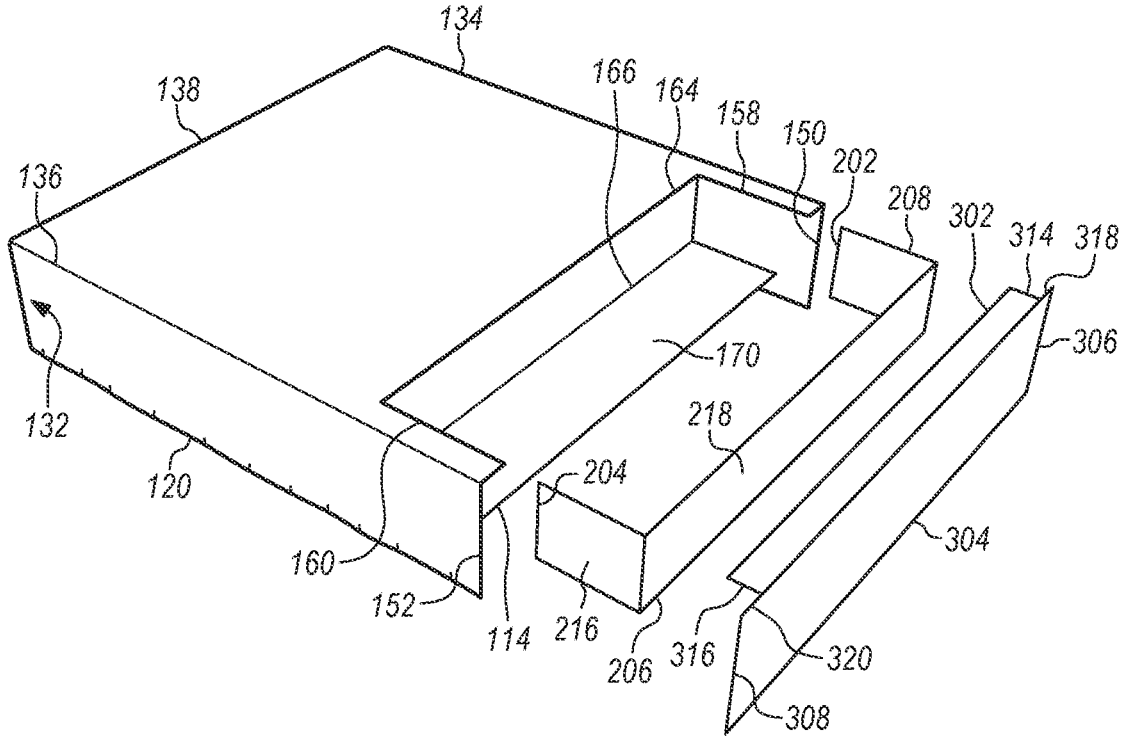
FIG. 4 shows an exploded view of the bedding shown in FIG. 3.

In the preferred embodiment, the bedding 100 comprises multiple, separate sheets that are fastened together to form the bedding 100 of the present invention. With reference to FIGS. 2 and 4, a base sheet 104 is fastened to a second sheet 200 to form the pocket 102. An end sheet 300 can be fastened to the base sheet 104 and the second sheet 200 to complete the bedding 100. In particular, the end sheet 300 can form the head end of the bedding. In some embodiments, the base sheet 104 and the second sheet 200 can be sufficient to cover the bed.

Figure 5:
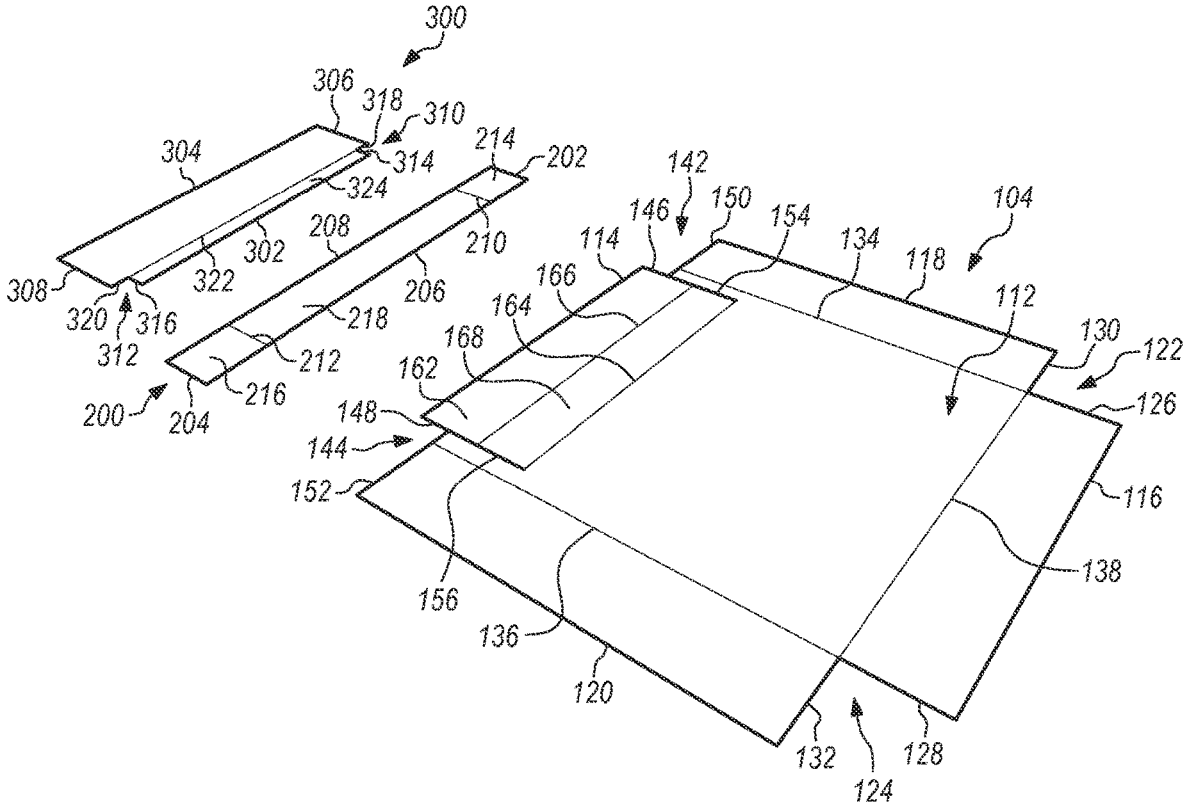
FIG. 5 shows an exploded view from the bottom side of the bedding with the separate sheets laid out flat.

With reference to FIG. 5, the base sheet 104 is generally a rectangular sheet comprising a top surface 110, a bottom surface 112 opposite the top surface 110, a head edge 114 adjacent to the top surface 110 and the bottom surface 112, a foot edge 116 opposite the head edge 114 and adjacent to the top surface 110 and the bottom surface 112, a first side edge 118 adjacent to the head edge 114, the foot edge 116, the top surface 110, and the bottom surface 112, and a second side edge 120 opposite the first side edge 118 and adjacent to the head edge 114, the foot edge 116, the top surface 110, and the bottom surface 112. The top surface 110 and bottom surface 112 are opposite sides of the same base sheet 104. The head edge 114, foot edge 116, first side edge 118, and second side edge 120 form the perimeter of the base sheet 104.

The head edge 114 of the base sheet 104 is placed adjacent to the head of the bed, which is the end of the bed closer to the negative space of the bed. The foot edge 116 is the edge of the base sheet 104 that is placed adjacent to the foot of the bed, which is the end further from the negative space and opposite the head end of the bed. The first side edge 118 and the second side edge 120 or the edges of the base sheet 104 that are placed adjacent to the sides of the bed.

At the foot edge 116 of the base sheet 104 notches 122, 124 can be created at the two opposite corners of the foot edge 116. Creating notches 122, 124 at the corners of the foot edge 116 of the base sheet 104 creates a first lateral foot edge 126 adjacent to the foot edge 116 and a second lateral foot edge 128 opposite the first lateral foot edge 126 and adjacent to the foot edge 116. In addition, creating notches 122, 124 at the corners of the foot edge 116 creates a first inferior side edge 130 adjacent to the first side edge 118 and the first lateral foot edge 126, and a second inferior side edge 132 opposite the first inferior side edge 130 and adjacent to the second side edge 120 and the second lateral foot edge 128.

Due to the notches 122, 124 at the foot edge 116, the first lateral foot edge 126 and the first inferior side edge 130 create approximately a right angle, and the second lateral foot edge 128 and the second inferior side edge 132 create approximately a right angle. As such, the first side edge 118 and the second side edge 120 can be folded downwardly at a first fold 134 and a second fold 136, respectively, in the direction of the bottom surface 112. Similarly, the foot edge 116 can be folded downwardly at a third fold 138 in the direction of the bottom surface 112 of the base sheet 104. Folding the foot edge 116 and the first side edge 118 as described above causes the first lateral foot edge 126 and the first inferior side edge 130 to come together where these two edges can be fastened together, for example, by stitching. Similarly, folding the foot edge 116 and the second side edge 120 as described above brings the second lateral foot edge 128 and the second inferior side edge 132 together where these two edges can be fastened together, for example, by stitching.

At the head edge 114 of the base sheet 104 notches 142, 144 can be created at the two opposite corners of the head edge 114 of the base sheet 104. Creating these notches 142, 144 at the corners of the base sheet 104 at the head edge 114 creates a first lateral head edge 146 adjacent to the head edge 114 and a second lateral head edge 148 opposite the first lateral head edge 146 and adjacent to the head edge 114. In addition, creating notches 142, 144 at the head edge 114 creates a first superior side edge 150 adjacent to the first side edge 118 and the first lateral head edge 146, and a second superior side edge 152 opposite the first superior side edge 150 and adjacent to the second side edge 120 and the second lateral head edge 148. In addition to the notches 142, 144, a first slit 154 can be created into the base sheet 104 to extend the length of the first lateral head edge 146 deeper into the base sheet 104 towards the foot edge 116. Similarly, a second slit 156 can be created into the base sheet 104 to extend the length of the second lateral head edge 148 deeper into the base sheet 104 towards the foot edge 116. Preferably, the first lateral head edge 146 is medial to the first fold 134 and the second lateral head edge 148 is medial to the second fold 136.

The first slit 154 not only lengthens the first lateral head edge 146 beyond the first superior side edge 150, but it also creates a first medial side edge 158 adjacent to the first lateral head edge 146. Similarly, the second slit 156 not only lengthens the second lateral head edge 148 beyond the second superior side edge 152, but it also creates a second medial side edge 160 adjacent to the second lateral head edge 148. The head edge 114, the first lateral head edge 146 and the second lateral head edge 148 define a pocket flap 162 that can be used to create the pocket 102. A fourth fold 164 can be created in the base sheet 104 extending laterally across from where the first slit 154 ends to where the second slit 156 ends. This fourth fold 164 allows the pocket flap 162 to drop downwardly perpendicular to the top surface 110 and bottom surface 112 of the base sheet 104. A fifth fold 166 can be created in the pocket flap 162 so that a portion of the pocket flap 162 can be bent to be parallel to the top surface 110 and bottom surface 112 of the base sheet 104. As such, the portion of the pocket flap 162 between the fourth fold 164 and the fifth fold 166 can form an inferior sidewall cover 168 that is perpendicular to the top surface 110 and bottom surface 112 of the base sheet 104, and configured to cover the inferior sidewall of the negative space of the bed. The portion of the flap 162 between the fifth fold 166 and the head edge 114 can form a floor cover 170 that is parallel to the top surface 110 and the bottom surface 112 of the base sheet 104, and configured to cover the floor of the negative space of the bed. When folded as described above, the head edge 114 is below the top surface 110 and bottom surface 112 of the base sheet 104, and the wall 168 and the floor 170 form a portion of the pocket 102 for covering for the negative space of the bed.

To complete the covering of the negative space of the bed, a second sheet 200 can be fastened to the base sheet 104. The second sheet 200 is generally a rectangular shaped sheet having a first edge 202, a second edge 204 opposite the first edge 202, a third edge 206 adjacent to the first edge 202 and the second edge 204, and a fourth edge 208 opposite the third edge 206 and adjacent to the first edge 202 and the second edge 204. Two folds can be created in the second sheet 200. A first fold 210 can be created adjacent to the first edge 202 and extending from the third edge 206 to the fourth edge 208. A second fold 212 can be created adjacent to the second edge 204 and extending from the third edge 206 to the fourth edge 208. These folds create a first flap 214 of the second sheet 200 in between the first edge 202 and the first fold 210, a second flap 216 of the second sheet 200 in between the second edge 204 and the second fold 212, and a middle section 218 in between the first flap 214 and the second flap 216. When properly folded, the first flap 214 and the second flap 216 are generally parallel to each other and perpendicular to the middle section 218. Arranged accordingly, the second sheet 200 can be fastened to the base sheet 104 to complete the covering of the negative space of the bed.

For example, the third edge 206 at the middle section 218 of the second sheet 200 can be fastened to the head edge 114 of the base sheet 104. The third edge 206 at the first flap 214 can be fastened to a superior portion of the first lateral head edge 146 at the floor cover 170 of the pocket flap 162 of the base sheet 104 (i.e., the portion of the pocket flap 162 that is superior to the fifth fold 166 when the base sheet is laid flat as shown in FIG. 5). The first edge 202 of the second sheet 200 at the first flap 214 can be fastened to an inferior portion of the first lateral head edge 146 at the inferior sidewall cover 168 of the flap 162 of the base sheet 104 (i.e., the portion of the pocket flap 162 that is inferior to the fifth fold 166 when the base sheet 104 is laid flat as shown in FIG. 5). The fourth edge 208 at the first flap 214 can be fastened to an inferior portion of the first medial side edge 158.

On the opposite side, the third edge 206 at the second flap 216 can be fastened to a portion of the second lateral head edge 148 at the floor 170 of the pocket flap 162 of the base sheet 104 (i.e. the portion of the pocket flap 162 that is superior to the fifth fold 166 when the base sheet is laid flat as shown in FIG. 5). The second edge 204 of the second flap 216 of the second sheet 200 can be fastened to a portion of the second lateral head edge 148 at the wall 168 of the pocket flap 162 of the base sheet 104 (i.e., the portion of the pocket flap 162 that is inferior to the fifth fold 166 when the base sheet is laid flat as shown in FIG. 5). The fourth edge 208 at the second flap 216 can be fastened to an inferior portion of the second medial side edge 160.

When fastened accordingly, the floor cover 170 of the pocket flap 162 of the base sheet 104 covers the floor defining the negative space of the bed. The inferior sidewall cover 168 of the pocket flap 162 of the base sheet 104 covers the inferior wall defining the negative space of the bed. The middle section 218 of the second sheet 200 defines a superior sidewall cover that covers the superior wall defining the negative space of the bed. The first flap 214 of the second sheet 200 defines a first lateral sidewall cover that covers the first lateral wall defining the negative space of the bed. The second flap 216 defines a second lateral sidewall cover that covers the second lateral wall defining the negative space of the bed. Therefore, the inferior sidewall cover, the superior sidewall cover, the first lateral sidewall cover, the second lateral sidewall cover, and the floor cover can make up the pocket 102 of the bedding 100.

When the base sheet 104 and second sheet 200 are fastened together, folded properly, and fitted onto a bed with the pocket 102 placed inside the negative space of the bed, the head of the bed can remain exposed. As such, a third sheet can be used as an end sheet 300 to cover the remaining exposed portion of the head of the bed while leaving the negative space of the bed accessible. The end sheet 300 can be a generally rectangular sheet having an upper edge 302, a lower edge 304 opposite the upper edge 302, a first lateral edge 306 adjacent to the upper edge 302 and the lower edge 304, and a second lateral edge 308 opposite the first lateral edge 306 and adjacent to the upper edge 302 and the lower edge 304. A first notch 310 can be created at the corner where the upper edge 302 meets the first lateral edge 306. A second notch 312 can be created at the corner where the upper edge 302 meets the second lateral edge 308.

The first notch 310 in the end sheet 300 creates a first upper lateral edge 314 perpendicular to the upper edge 302 and adjacent to the first lateral edge 306. The first notch 310 in the end sheet 300 also creates a first lateral upper edge 318 perpendicular and adjacent to the first lateral edge 306 and the first upper lateral edge 314. Similarly, the second notch 312 in the end sheet 300 creates a second upper lateral edge 316 perpendicular to the upper edge 302 and adjacent to the second lateral edge 308. The second notch 312 in the end sheet 300 also creates a second lateral upper edge 320 perpendicular and adjacent to the second lateral edge 308 and the second upper lateral edge 316. An upper fold 322 can be created in line with the first lateral upper edge 318 and the second lateral upper edge 320 extending from the first upper lateral edge 314 to the second upper lateral edge 316, thereby creating an upper flap 324.

When assembled, the upper edge 302 of the end sheet 300 can be fastened to the fourth edge 208 of the second sheet 200 at the middle section 218. The first upper lateral edge 314 can be fastened to a superior portion of the first medial side edge 158 of the base sheet 104. The second upper lateral edge 316 can be fastened to a superior portion of the second medial side edge 160 of the base sheet 104. The first lateral upper edge 318 of the end sheet 300 can be fastened to the base sheet 104 at a medial portion of the first superior side edge 150 medial to the first fold 134. The second lateral upper edge 320 of the end sheet 300 can be fastened to the base sheet 104 at a medial portion of the second superior side edge 152 medial to the second fold 136. The upper fold 322 of the end sheet 300 allows the remaining portion of the end sheet 300 to fall down and cover the head end of the bed. The first lateral edge 306 of the end sheet 300 can be fastened to the base sheet 104 at a lateral portion of the first superior side edge 150 lateral to the first fold 134. The second lateral edge 308 of the end sheet 300 can be fastened to the base sheet 104 at a lateral portion of the second superior side edge 152 lateral to the second fold 136.

In the preferred embodiment, the bedding 100 of the present invention is a fitted sheet. As such, an elastic band can be fastened along the lower edge 304 of the end sheet 300 and along the base sheet 104 at the first side edge 118, the foot edge 116, and the second side edge 120, thereby interconnecting the lower edge 304, the first side edge 118, the foot edge 116, and the second side edge 120. The elastic band allows these edges to wrap underneath the bed to secure the bedding 100 to the bed.

The bedding 100 can be configured to fit beds with negative space of various sizes, such as a twin, twin XL, full, queen, king, Eastern king, and California king size beds. As such, the distance from the first fold 134 to the second fold 136 of the base sheet 104 can be sufficiently wide to fit the width of the bed. The distance from the third fold 138 of the base sheet 104 to the upper fold 322 of the end sheet 300 can be sufficiently long to fit the length of the bed. The distance from the first fold 134 to the first side edge 118 of the base sheet 104, the distance from the second fold 136 to the second side edge 120 of the base sheet 104, the distance from the third fold 138 to the foot edge 116 of the base sheet 104, and the distance from the upper fold 322 of the end sheet 300 to the lower edge 304 of the end sheet 300 can each be sufficiently deep to fit the depth (or thickness) of the bed in a manner that allows the bedding to tuck underneath the bed when properly installed on the bed.

The distance from the fourth fold 164 of the base sheet 104 to the fourth edge 208 of the second sheet 200 can be approximately the width of the negative space of the bed (i.e., in the superior-inferior direction). The distance from the first medial side edge 158 to the second medial side edge 160 of the base sheet 104 can be approximately the length of the negative space of the bed (which is in the lateral direction of the bed). The distance from the fourth fold 164 of the base sheet 104 to the fifth fold 166 is approximately the depth of the negative space of the bed, including the thickness of any upper layer of the bed. These dimensions are configured to allow the pocket 102 of the bedding 100 to fit inside the negative space of the bed.

The bedding 100 as disclosed herein is believed to be an efficient method of manufacturing the bedding 100 for a bed with negative space with the best conservation of materials. Other configurations can be used and have been contemplated. For example, the base sheet 100 can define an opening corresponding to the negative space of the bed. The pocket 102 can be made from a rectangular sheet with all four corners containing notches that allow adjacent edges to be fastened together so as to form an open box configuration. The edges defining the open box can be fastened to the edges defining the opening in the base sheet.

The bedding 100 can be made using standard techniques and machines for making bed sheets. The notches and slits can be cut or punched into the bedding 100.

In use, the bedding 100 is laid on top of a bed with negative space. The pocket 102 of the bedding 100 is inserted into the negative space of the bed. The first side edge 118, the foot edge 116, the second side edge 120, and the lower edge 304 can be tucked underneath the bottom of the bed with negative space. An elastic band can be attached to the first side edge 118, the foot edge 116, the second side edge 120, and the lower edge 304 to help keep these edges tucked underneath the bottom of the bed.

INDUSTRIAL APPLICABILITY

This invention may be industrially applied to the development, manufacture, and use of bedding 100 having a pocket 102 configured to fit on beds with negative space into which pillows can be inserted. Users can then lie on the bed, insert their arms into the negative space while resting their heads on the pillows.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A bedding for a bed with negative space, the bedding comprising:

a) a generally rectangular base sheet comprising a top surface, a bottom surface opposite the top surface, a head edge adjacent to the top surface and the bottom surface, a foot edge opposite the head edge and adjacent to the top surface and the bottom surface, a first side edge adjacent to the head edge, the foot edge, the top surface, and the bottom surface, and a second side edge opposite the first side edge and adjacent to the head edge, the foot edge, the top surface, and the bottom surface;

b) a second sheet connected to the base sheet at the head edge to form a pocket descending below the bottom surface;

c) an end sheet connected to the second sheet and the base sheet; and d) an elastic band connected to the end sheet and the base sheet to form a fitted sheet, wherein the second sheet is rectangular, having a first edge, a second edge opposite the first edge, a third edge adjacent to the first edge and the second edge, and a fourth edge opposite the third edge and adjacent to the first edge and the second edge, wherein the first edge is stitched to the base sheet at a first corner to form a first seam configured for structural integrity at the first corner, the second edge is stitched to the base sheet at a second corner to form a second seam configured for structural integrity at the second corner, the third edge is stitched to the base sheet at a third corner to form a third seam configured for structural integrity at the third corner, and the fourth edge of the second sheet is fastened to the end sheet to form a fourth seam configured for structural integrity at a fourth corner, wherein the pocket defines an inferior sidewall cover, a superior sidewall cover adjacent to the end sheet and opposite the inferior sidewall cover, a first lateral sidewall cover adjacent to the inferior sidewall cover and the superior sidewall cover, a second lateral sidewall cover opposite the first lateral sidewall cover and adjacent to the inferior sidewall cover and the superior sidewall cover, and a floor cover adjacent to the inferior sidewall cover, the superior sidewall cover, the first lateral sidewall cover, and the second lateral sidewall cover.

2. The bedding of claim 1, wherein the base sheet makes up the inferior sidewall cover and the floor cover.

3. The bedding of claim 2, wherein the second sheet makes up the first lateral sidewall cover, the superior sidewall cover, and the second lateral sidewall cover.

4. The bedding of claim 3, wherein the end sheet is generally rectangular having an upper edge, a lower edge opposite the upper edge, a first lateral edge adjacent to the upper edge and the lower edge, and a second lateral edge opposite the first lateral edge and adjacent to the upper edge and the lower edge, wherein the first lateral edge and the second lateral edge are fastened to the base sheet.

5. The bedding of claim 4, wherein the base sheet comprises:

a) a first notch adjacent to the head edge and the first side edge, the first notch of the base sheet defining a first lateral head edge adjacent to the head edge, and a first superior side edge adjacent to the first lateral head edge and the first side edge;

b) a second notch adjacent to the head edge and the second side edge, the second notch of the base sheet defining a second lateral head edge opposite the first lateral head edge and adjacent to the head edge, and a second superior side edge adjacent to the second lateral head edge and the second side edge;

c) a first slit extending the first lateral head edge towards the foot edge; and d) a second slit extending the second lateral head edge towards the foot edge.

6. The bedding of claim 5, wherein the end sheet comprises:

a) a first notch adjacent to the upper edge and the first lateral edge, the first notch defining a first upper lateral edge perpendicular to the upper edge and adjacent to the first lateral edge, and a first lateral upper edge perpendicular and adjacent to the first lateral edge and the first upper lateral edge; and b) a second notch adjacent to the upper edge and the second lateral edge, the second notch defining a second upper lateral edge perpendicular to the upper edge, and a second lateral upper edge perpendicular and adjacent to the second lateral edge and the second upper lateral edge, c) wherein the first lateral upper edge and the first lateral edge are fastened to the first superior side edge, and the second lateral upper edge and the second lateral edge are fastened to the second superior side edge.

7. A method of manufacturing a bedding for a bed with negative space, the bedding comprising a head end; a foot end opposite the head end; a first side adjacent to the head end and the foot end; a second side opposite the first side and adjacent to the head end and the foot end, and a pocket in between the first side and the second side and adjacent to the head end, the method comprising:

a) providing a base sheet, comprising: a top surface, a bottom surface opposite the top surface, a head edge adjacent to the top surface and the bottom surface, a foot edge opposite the head edge and adjacent to the top surface and the bottom surface, a first side edge adjacent to the head edge, the foot edge, the top surface, and the bottom surface, and a second side edge opposite the first side edge and adjacent to the head edge, the foot edge, the top surface, and the bottom surface;

b) fastening a second sheet to the base sheet to form the pocket that descends below the bottom surface of the base sheet, wherein the second sheet is fastened to the base sheet by stitching a first edge of the second sheet to the base sheet to form a first corner with structural integrity, and stitching a second edge of the second sheet to the base sheet to form a second corner with structural integrity; and c) fastening an end sheet to the base sheet and the second sheet to form the head end of the bedding, wherein the second sheet is rectangular defined by the first edge, the second edge opposite the first edge, a third edge adjacent to the first edge and the second edge, and a fourth edge opposite the third edge and adjacent to the first edge and the second edge, wherein the second sheet defines a first flap adjacent to the first edge, a second flap adjacent to the second edge, and a middle section in between the first flap and the second flap.

8. The method of claim 7, further comprising:

a) creating a first notch in the base sheet adjacent to the head edge and the first side edge, the first notch of the base sheet defining a first lateral head edge adjacent to the head edge, and a first superior side edge adjacent to the first lateral head edge and the first side edge;

b) creating a second notch in the base sheet adjacent to the head edge and the second side edge, the second notch of the base sheet defining a second lateral head edge opposite the first lateral head edge and adjacent to the head edge, and a second superior side edge adjacent to the second lateral head edge and the second side edge;

c) creating a first slit extending the first lateral head edge towards the foot edge;

d) creating a second slit extending the second lateral head edge towards the foot edge;

e) fastening the third edge of the second sheet at the middle section to the head edge of the base sheet;

f) fastening the third edge of the second sheet at the first flap to a superior portion of the first lateral head edge of the base sheet;

g) fastening the first edge of the second sheet at the first flap to an inferior portion of the first lateral head edge of the base sheet;

h) fastening the third edge of the second sheet at the second flap to a superior portion of the second lateral head edge of the base sheet; and i) fastening the second edge of the second sheet at the second flap to an inferior portion of the second lateral head edge of the base sheet, whereby the base sheet in between the superior portion of the first lateral head edge and the superior portion of the second lateral head edge defines a floor cover of the pocket, the base sheet in between the inferior portion of the first lateral head edge and the inferior portion of the second lateral head edge defines an inferior sidewall cover of the pocket, the first flap of the second sheet defines a first lateral sidewall cover of the pocket, the second flap of the second sheet defines a second lateral sidewall cover of the pocket, and the middle section of the second sheet defines a superior sidewall cover of the pocket adjacent to the head end of the bedding and opposite the inferior sidewall cover.

9. The method of claim 8, further comprising:

a) creating a first notch adjacent to the upper edge and the first lateral edge of the end sheet, the first notch defining a first upper lateral edge perpendicular to the upper edge and adjacent to the first lateral edge, and a first lateral upper edge perpendicular and adjacent to the first lateral edge and the first upper lateral edge;

b) creating a second notch adjacent to the upper edge and the second lateral edge, the second notch defining a second upper lateral edge perpendicular to the upper edge, and a second lateral upper edge perpendicular and adjacent to the second lateral edge and the second upper lateral edge;

c) fastening the first lateral upper edge of the end sheet to a medial portion of the first superior side edge of the base sheet;

d) fastening the first lateral edge of the end sheet to a lateral portion of the first superior edge of the base sheet;

e) fastening the second lateral upper edge of the end sheet to a medial portion of the second superior side edge of the base sheet;

f) fastening the second lateral edge of the end sheet to a lateral portion of the second superior side edge of the base sheet; and g) fastening the upper edge of the end sheet to the fourth edge of the second sheet.

10. The method of claim 9, further comprising:

a) creating a first fold in the base sheet from where the first slit ends to where the second slit ends to form an inferior sidewall cover; and b) creating a second fold in the base sheet between the first fold and the head edge to form a floor cover.

* * * * *